US005676062A

United States Patent [19]

Lloyd

[11] Patent Number: 5,676,062

[45] Date of Patent: Oct. 14, 1997

[54] COLLAPSIBLE MASSAGE TABLE

[76] Inventor: John T. Lloyd, 80926 Turkey Run Rd., Creswell, Oreg. 97426

[21] Appl. No.: 717,837

[22] Filed: Sep. 23, 1996

[51] Int. Cl.[6] ..... A47B 3/00

[52] U.S. Cl. ..... 108/36; 108/132

[58] Field of Search ..... 108/36, 34, 35, 108/38, 130, 131, 132; 5/620; 269/901

[56] References Cited

U.S. PATENT DOCUMENTS 3,359,576 12/1967 Pile .
4,333,638 6/1982 Gillotti .
4,833,998 5/1989 Everett et al. .
4,927,128 5/1990 O'Brian .
4,943,041 7/1990 Romein .
5,009,170 4/1991 Spehar .
5,177,823 1/1993 Riach .
5,335,676 8/1994 O'Brien .
5,524,555 6/1996 Fanuzzi .

*Primary Examiner*—Peter M. Cuomo
*Assistant Examiner*—Gerald A. Anderson
*Attorney, Agent, or Firm*—Kolisch, Hartwell, Dickinson, McCormack & Heuser

[57] ABSTRACT

A collapsible massage table has two sides, each side being supported by a support structure including two legs. Each leg is connected to the center of the table by a brace having an articulating joint. Two cable lines stabilize the leg structure. Each cable line connects pivot points of legs on opposing ends of the table and at least one of the articulating brace joints.

16 Claims, 7 Drawing Sheets

COLLAPSIBLE MASSAGE TABLE

FIELD OF THE INVENTION

The invention relates to tables, particularly lightweight collapsible massage tables. The invention involves a lightweight support structure for maintaining a collapsible table in an erect or upright position.

BACKGROUND OF THE INVENTION

Many forms of massage require a special type of table. The table must be capable of supporting a persons entire body weight in a horizontal position. The table should be padded on the upper surface, and it should be adjustable to a height which is appropriate for the masseuse or therapist. For many applications, these objectives must be met in a lightweight collapsible table design because it is often desirable to carry the table to different massage locations. It is also helpful to be able to collapse a massage table for compact storage.

Collapsible massage tables have been designed over the years to satisfy these objectives. U.S. Pat. No. 5,009,170 to Spehar discloses a collapsible massage table which employs a diagonal brace for each table leg and a pair of cables connecting the pivot points of the legs to the articulation points of the braces for the purpose of automatically extending the legs when the table is open, and locking the legs in their upright position while the table is being used. However, the Spehar table fails to provide direct support under the central hinge region of the table. Another problem with Spehar's table is that it requires a relatively low potentially interfering horizontal cable line on each side of the table between the brace joints. This cable line may interfere with certain types of massage techniques or therapies where it is necessary to position the therapist's legs partially under the table. Other collapsible table designs such as the one shown in U.S. Pat. No. 4,833,998 to Everett et al., utilize an inverted truss in cooperation with a taut cable to provide support in the central region of the table when the table is erect. However, Everett et al.'s inverted truss arrangement does not provide sufficient support and leg stabilization for some massage applications. Accordingly, there is a need for a lightweight collapsible massage table which has an integrated support structure for automatically opening and maintaining table legs in an upright position while the table is in use as well as providing sturdy upward support in the center region of the table.

SUMMARY OF THE INVENTION

The invention provides a collapsible table including a table top formed by two table pieces which are hinged to each other so that when the table is erect the pieces are substantially coplanar and when the table is collapsed the table portions fold together. The table top has two sides. Each side of the table has a medial region located between first and second ends. Each side of the table is supported by a support structure which includes a first leg pivotally attached at point A below the first end of the side. A second leg is pivotally attached at point B below the second end of the side. A first brace connects the first leg to the medial region of the side. The first brace has an articulating joint at point C. A second brace connects the second leg to the medial region of the side. The second brace has an articulating joint at point D. A first cable line rims from point A to point D to point B. A second cable line runs from point A to point C to point B.

In one embodiment of the invention, the support structure employs a truss member which extends down from the medial region of the side of the table and impinges on the first cable line between points A and D and on the second cable line between points C and B.

Each cable line may be made of a single piece of cable or may consist of plural discreet cable pieces connected at common points along the line. In a preferred embodiment, each cable line is severable and detachable at the point of attachment to the truss member so that the truss member and the cables can be efficiently folded into and contained inside the collapsed table and alteratively, the table can be open for use on a floor without extending the legs.

DESCRIPTION OF THE INVENTION

Figure 1:
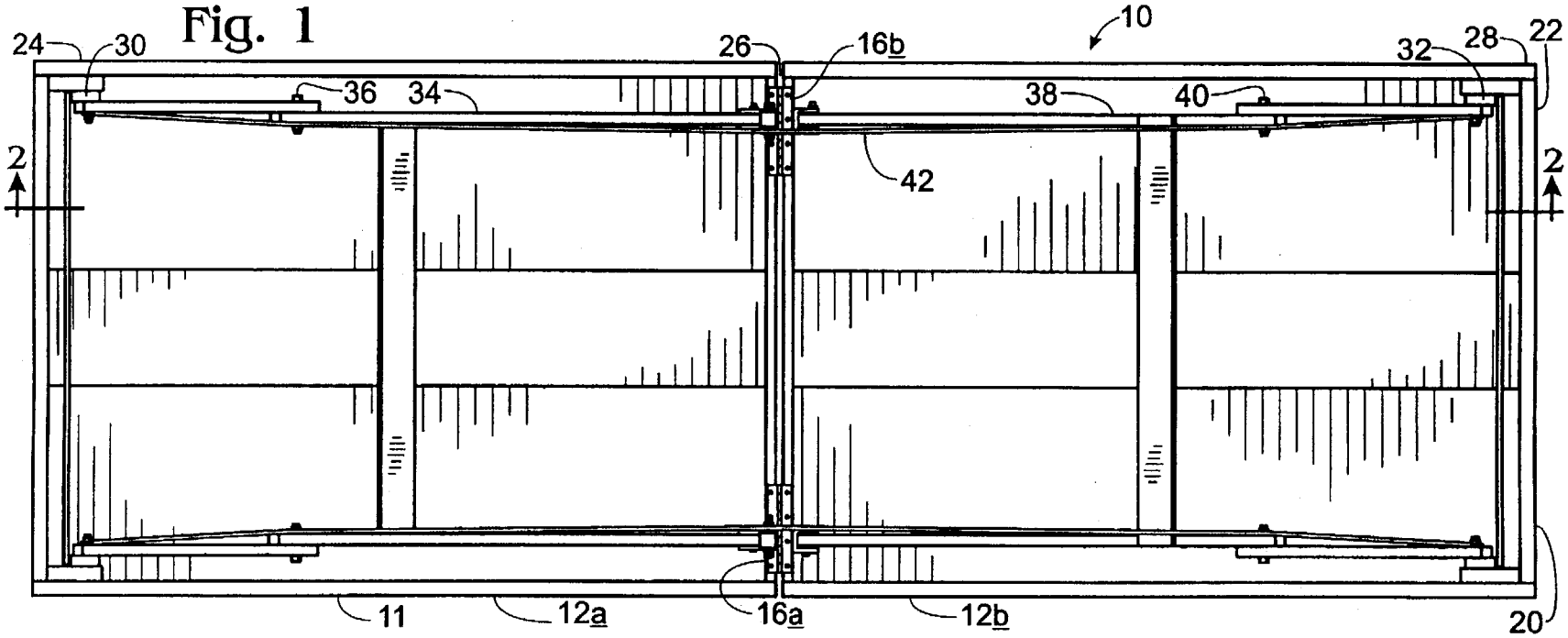
FIG. 1 is an underneath plan view of a table in accordance with the present invention.
Figure 3:
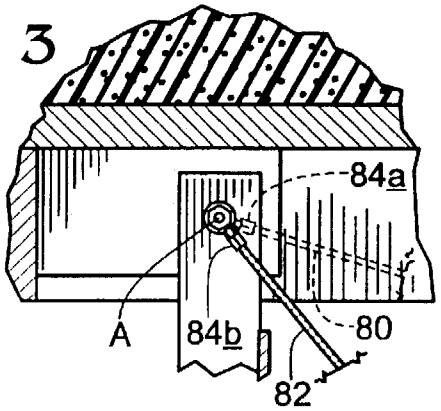
FIG. 3 is a partial enlarged view of a portion of the table shown in FIG. 2.

A collapsible massage table 10 is shown in FIG. 1. Table top 11 is made of two table pieces 12*a* and 12*b*, which are attached to each other by hinges 16*a* and 16*b*. Table 10 has two sides 20 and 22. Support structure associated with side 22 will be described and illustrated in more detail below. Unless otherwise indicated, it may be assumed that the support structure under table side 20 is the same as the structure described for table side 22. Table side 22 has first end 24, medial region 26, and second end 28. First leg 30 is pivotally attached below first end 24 of table side 22. Second leg 32 is pivotally attached below end 28 of table side 22. First brace 34 has an articulating joint 36, and connects a point on leg 30 to the medial region 26 of table side 22. Second brace 38 has an articulating joint 40, and connects a point on leg 32 to medial region 26 of table side 22.

Figure 2:
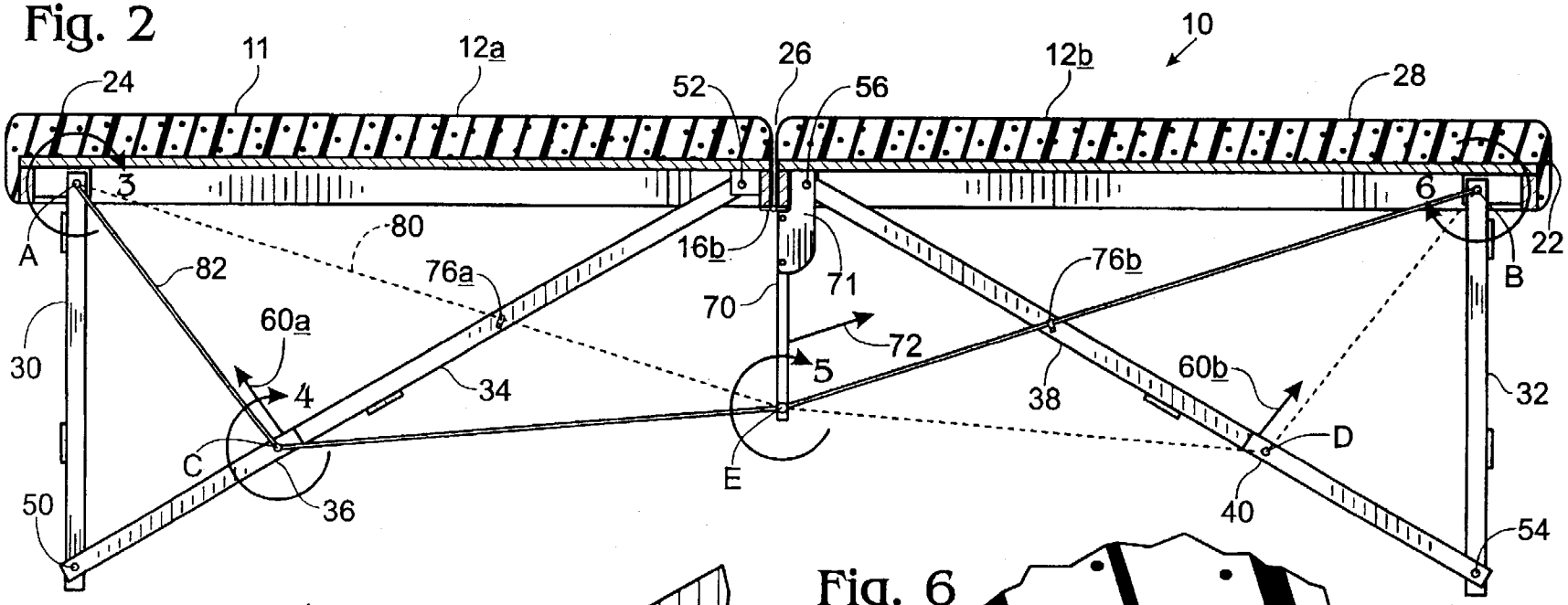
FIG. 2 is a cross-sectional side view of the table shown in FIG. 1.

A cross-sectional view of the table shown in FIG. 1 is illustrated in FIG. 2. Collapsible massage table 10 includes table top 11 in its erect, i.e., open and upright position. Table top 11 has two table pieces 12*a* and 12*b* connected by hinges 16*a* (not shown) and 16*b*. Table side 22 has first end 24, medial region 26 and second end 28. First leg 30 is pivotally attached at point A below end 24 of table side 22. Second leg 32 is pivotally attached at point B below end 28 of table side 22. First brace 34 connects point 50 on leg 30 to point 52 in medial region 26 of side 22. First brace 34 has an articulating joint or hinge mechanism 36 at point C. Second brace 38 connects point 54 on leg 32 to point 56 in the medial region of table side 22. Brace 38 has an articulating joint or hinge mechanism 40 at point D. Arrows 60*a* and 60*b* indicate the directions toward which braces 34 and 38, respectively, fold when the table is collapsed.

Truss member 70 is pivotally attached via bracket 71 to medial region 26 under table piece 12*b*. Arrow 72 indicates the direction toward which truss member 70 folds when table 10 is collapsed. Bracket 71 is dimesioned to fold around the sides of brace 38 allowing truss member 70 to fold against the brace when the table legs are collapsed.

Legs 30 and 32 are opened and maintained in their open positions by cable lines 80 and 82. Each of cable lines 80 and 82 may be a single cable connecting points A and B or plural discreet cables connected at common points along the line. Cable line 80 runs from point A to point D to point B. Cable line 80 functions to prevent brace 38 from pivoting or folding toward it's collapsed position in the direction of arrow 60*b*. Similarly, cable line 82 runs from point A to point C to point B. Cable line 82 prevents brace 34 from pivoting or folding toward it's collapsed position in the direction of arrow 60*a*, thereby locking the table in its open position when it is being used. Cable lines 80 and 82 also function as a foundation for truss member 70. Each of cable lines 80 and 82 are attached at point E to truss member 70. The tension of cable lines 80 and 82 are set up in conjunction with the dimension, i.e. length, of truss member 70 so that truss member 70 cooperatively places tension on cable lines 80 and 82 for leg locking purposes while also providing upward support strength in the medial region of the table on side 22.

As shown in FIG. 2, cable lines 80 and 82 connect to truss member 70 at common point E which, for cable line 80 is between points A and D, and for cable line 82, is between points C and B.

Cable line 80 is also attached to brace 34 by bracket 76*a* at a point of natural intersection with brace 34. Similarly, cable line 82 is attached to brace 38 by bracket 76*b* at a point of natural intersection with brace 38.

Figure 2A:
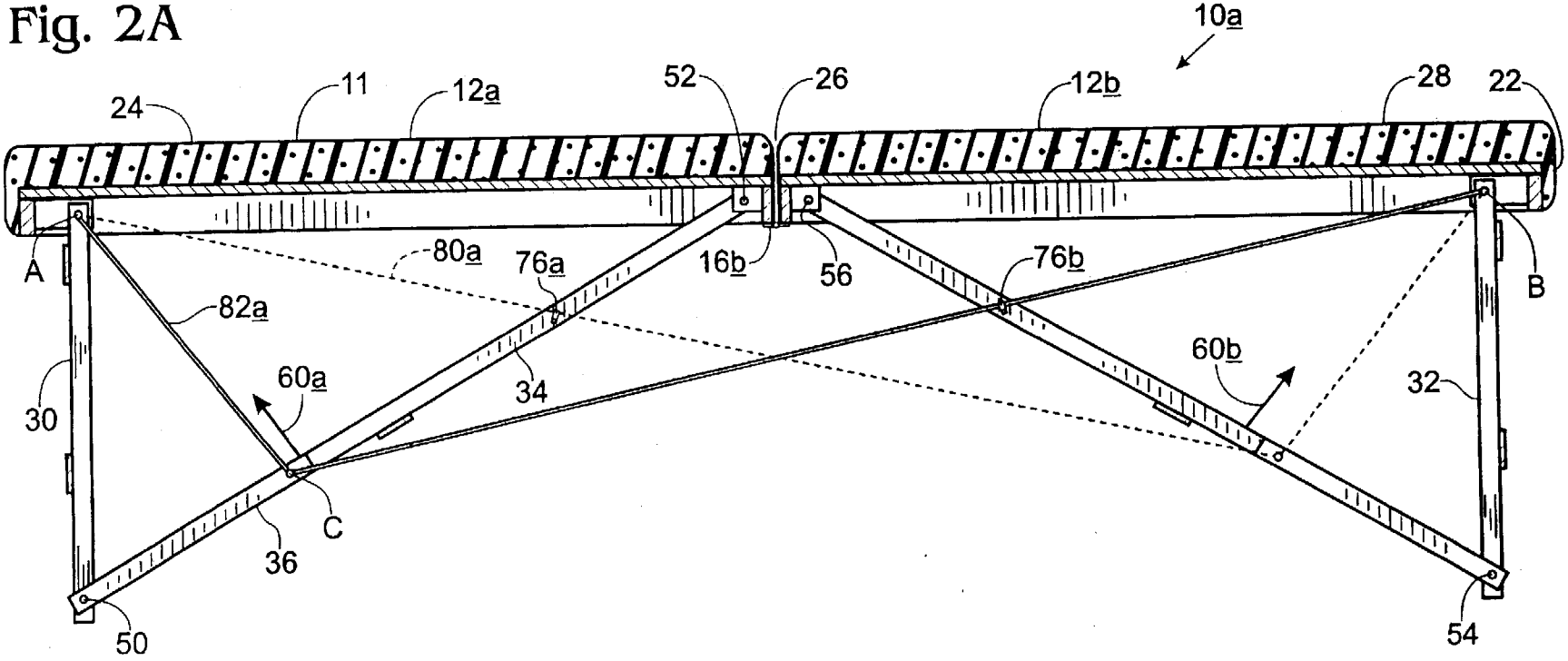
FIG. 2A is a cross-sectional side view of a modified table of the present invention.

The table shown in FIG. 2A is the same as the one shown in FIG. 2 except truss member 70 has been eliminated. The same numbers are used in 2A as were used in FIG. 2 for structures which are the same. Cable lines 80*a* and 82*a* are slightly shorter than their counterparts in FIG. 2 because their path is shorter due to elimination of truss member 70.

It can be appreciated from FIGS. 2 and 2A that cable lines 80 and 82 from FIG. 2 and 80*a* and 82*a* from FIG. 2A are higher and therefore more out of the way in the center region of the table compared to prior cable support systems in which a direct cable line connects the brace joints on each side of the table.

FIGS. 3–6 show preferred mechanisms for attaching cable lines at points indicated in FIGS. 2 and 2A. The portion of table 10 indicated by circular arrow 3 in FIG. 2 is blown up in FIG. 3. Ends of cable lines 80 and 82 have eyelets 84*a* and 84*b* connected to common point A at or near the point where leg 30 is pivotally connected under end 24 of table side 22.

Figure 4:
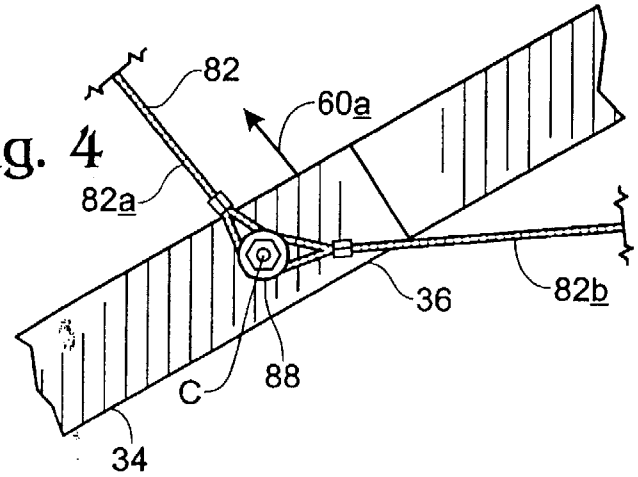
FIG. 4 is a partial enlarged view of a portion of the table shown in FIG. 2.

FIG. 4 shows a blown up view of the portion of FIG. 1 indicated by circular arrow 4 in the region of articulating joint 36 of brace 34. As shown in FIG. 4, cable line 82 includes discreet cable pieces 82*a* and 82*b* which are connected around spool 88 at point C.

Figure 5A:
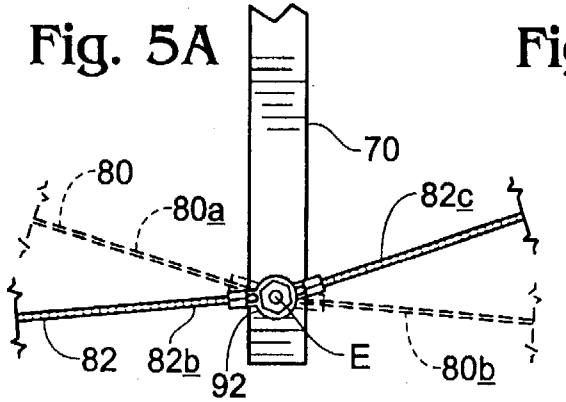
FIGS. 5 and 5A are partial enlarged views of alternative attachment mechanisms for a portion of the table shown in FIG. 2.
Figure 5:
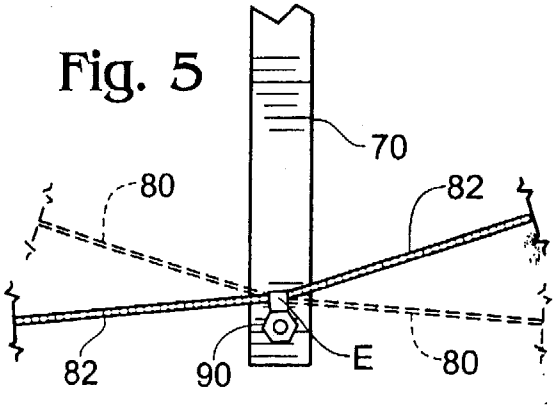

FIGS. 5 and 5A show alternative connection mechanisms for use with truss member 70 at the location indicated by circular arrow 5 in FIG. 2. In FIG. 5 a clamp or fitting such as a tube clamp, P-clamp, etc. is used at point E to connect continuous portions of cable lines 80 and 82 to a side of truss member 70. Alternatively, in FIG. 5A eyelets 92 are used at point E to connect ends of discreet cable pieces 82*b* and 82*c* from cable line 82, and to connect ends of discreet cable pieces 80*a* and 80*b* from cable line 80. Eyelets 92 fit over a bolt which goes through the truss member. Eyelets 92 are locked in position on the side of truss member 70 with a wing nut (not shown). The advantage of this design is that the wing nut can be removed easily allowing detachment of the cables from truss member 70 so that all pieces can be more efficiently and compactly folded within the table pieces when the table is collapsed. The ability to separate and detach cable lines 80 and 82 from truss member 70 also enables the table legs and all support structure to be collapsed and completely contained under the table while the table pieces remain open. This option is important for certain types of massage such as Shiatsu where it is desirable to place the table on the floor without table leg supports.

Figure 6:
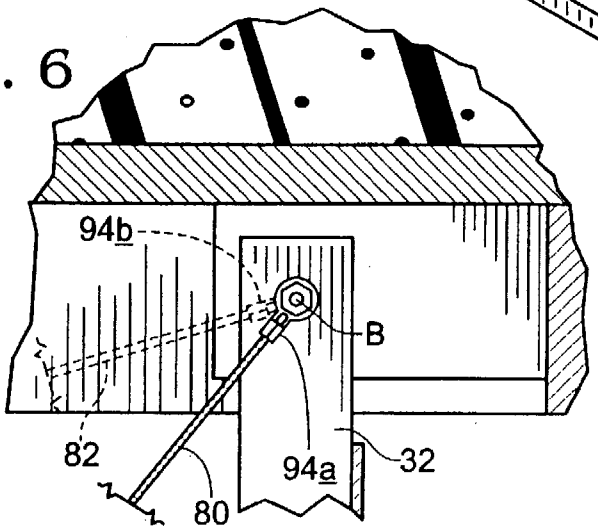
FIG. 6 is a partial enlarged view of the table shown in FIG. 2.

FIG. 6 is a blown up view of the table portion indicated by circular arrow 6 in FIG. 2. Similar to FIG. 3, it shows ends of cable lines 80 and 82 fitted with eyelets 94*a* and 94*b* respectively, connected to point B at or near the point where leg 32 is pivotally connected to end 28 of table side 22.

Figure 7:
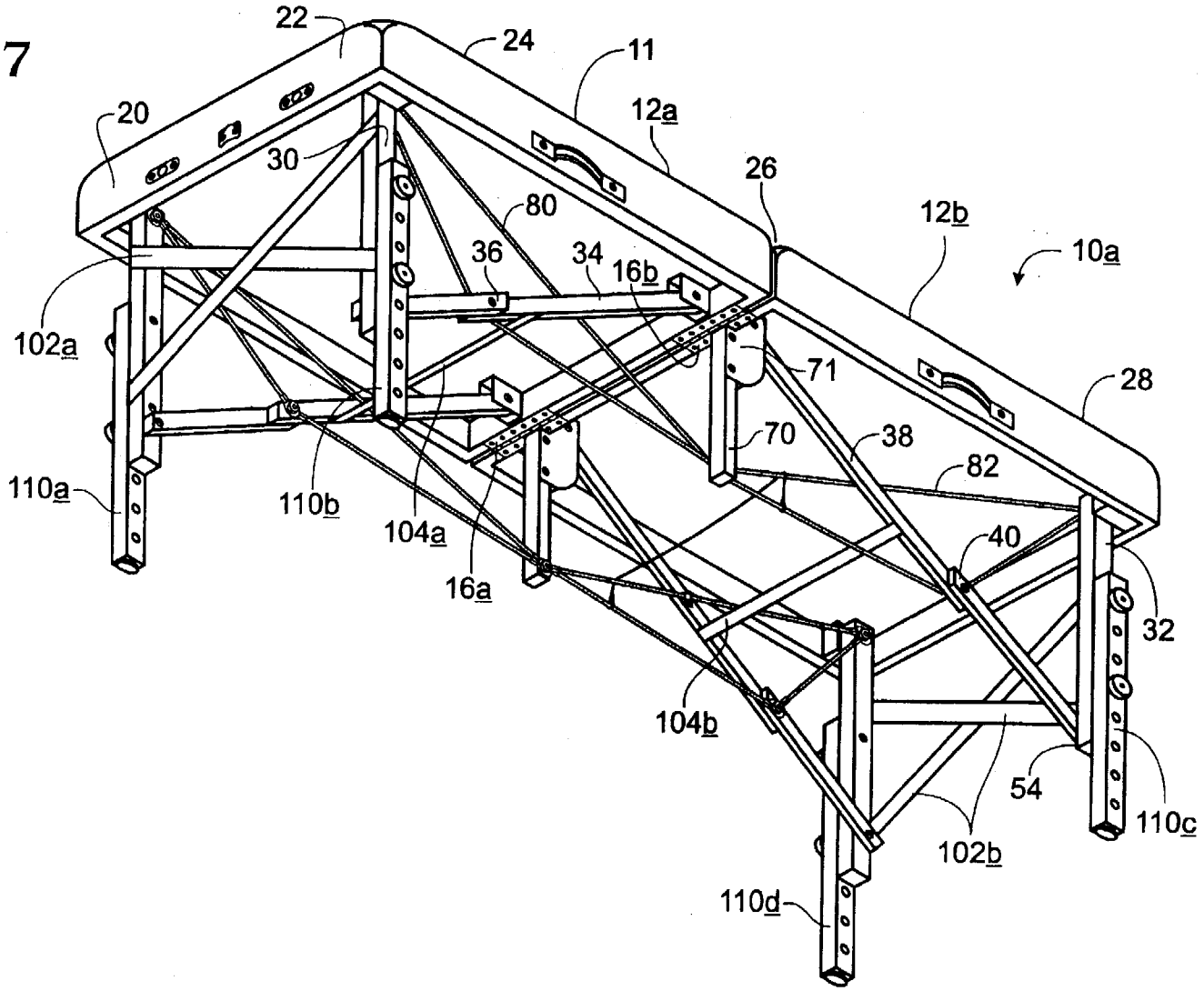
FIG. 7 is an underneath perspective view of the table shown in FIGS. 1 and 2.

FIG. 7 shows a table very similar to the one shown in FIGS. 1 and 2, from a bottom perspective view. Elements of table 10*a* in FIG. 7 which are the same as elements of table 10 in FIGS. 1 and 2, have the same numbers. It can be seen in FIG. 7 that the support system under side 22 of table top 11 is essentially the same as the support system under side 20. The support system under side 22 has already been described in detail with respect to FIGS. 1 and 2. Additionally, FIG. 7 shows cross braces 102*a* and 102*b* connecting and stabilizing respective leg pairs on opposing ends of table 10*a*. Similarly, cross brace 104*a* connects brace 34 to the corresponding brace under side 20 of table top 11, and cross brace 104*b* connects brace 38 to the corresponding brace under side 20 of table top 11.

Table 10*a* also is equipped with leg extension members 110*a*, 110*b*, 110*c*, and 110*d* each of which is variably extendible from its respective table leg for the purpose of adjusting the height of table top 11.

Figure 8:
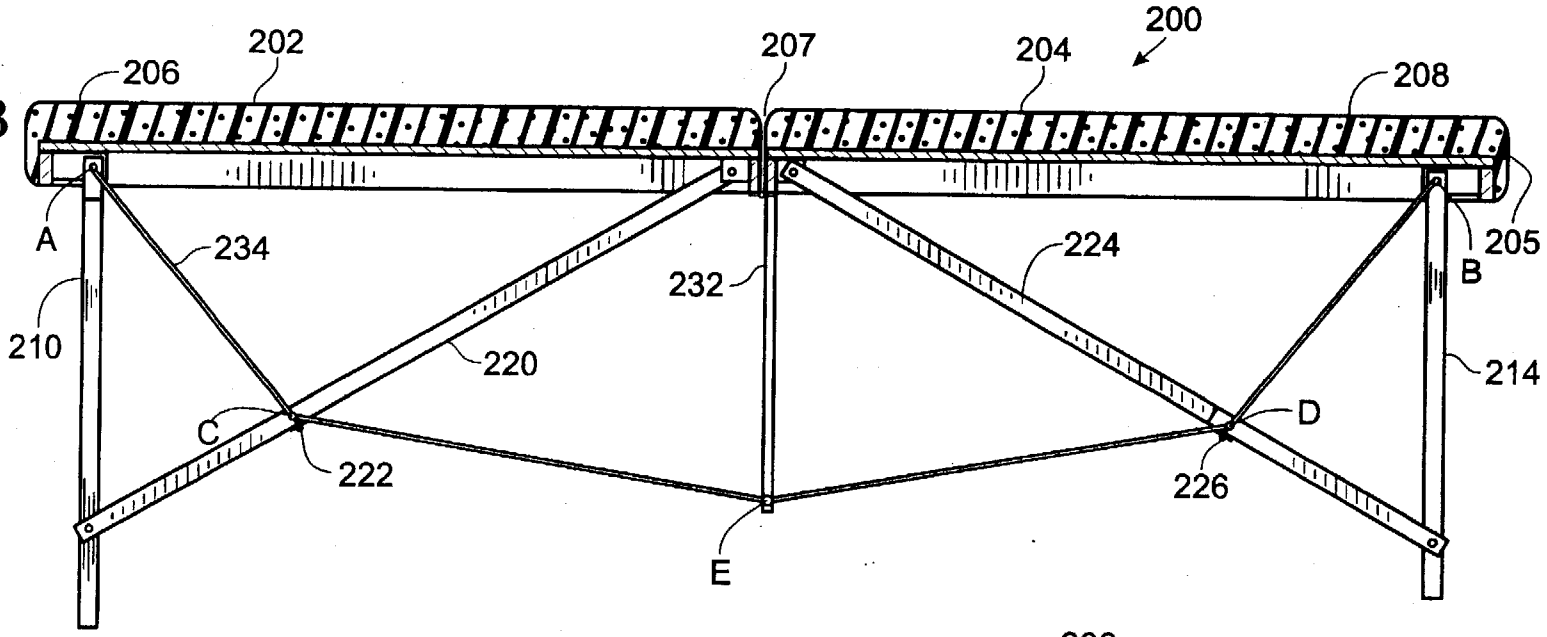
FIG. 8 is a schematic cross-sectional side side view of another table embodiment of the present invention.

FIG. 8 shows an alternative embodiment of the invention. Collapsible table 200 is formed by two table pieces 202 and 204 which are connected to each other by hinges as described previously. The table top has two sides only one 205 of which is shown in FIG. 8. The support structure used to support the other side of table 200 is the same as the illustrated one. Table side 205 is supported by the support structure shown in FIG. 8. Table side 205 has first end 206, medial region 207 and second end 208. Leg 210 is pivotally attached at point A below end 206. Leg 214 is pivotally attached below end 208 of table side 205. First brace 220 connects first leg 210 to medial region 207 of table side 205. Brace 220 has an articulating joint 222 which folds toward point A when the table is collapsed. Similarly, second brace 224 connects leg 214 to medial region 207 of table side 205. Brace 224 has an articulating joint 226 which folds toward point B when table 200 is collapsed. Truss member 232 extends downward from central region 207 to point E. Cable line 234 rims from point A to point C to point E to point D to point B. The line of cable connection from leg joints through brace joints provides auto-opening and locking functions for the table's support structure, while at the same time providing an upward force on truss member 232, thereby strengthening the medial region of table side 205. A similar support structure including another truss is used on the other side of the table.

Figure 9:
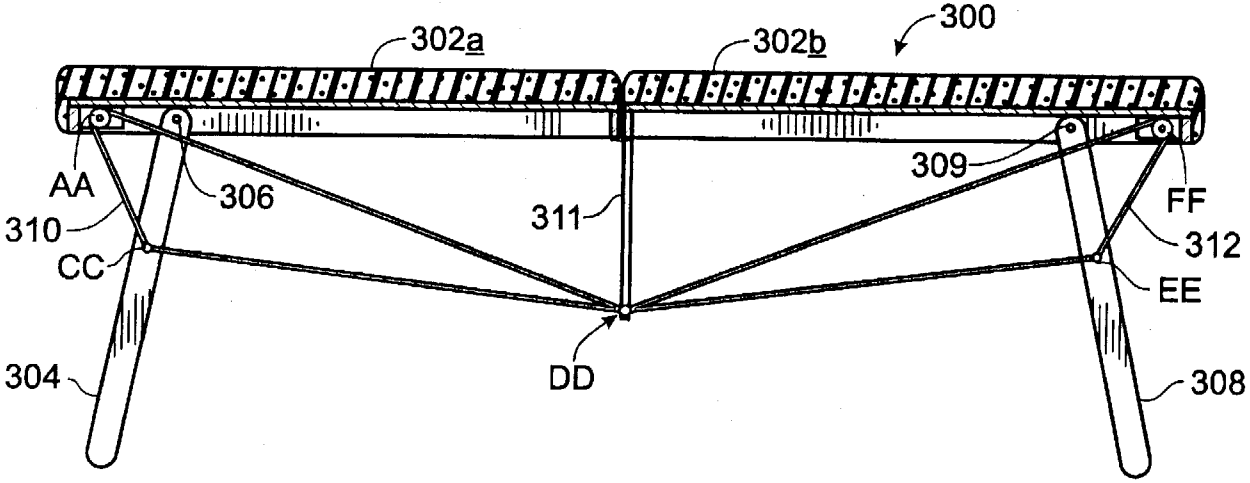
FIG. 9 is a schematic side view of an alternate embodiment of a collapsible massage table of the present invention in which leg braces have been eliminated. Each of FIGS. 10 and 11 show modifications of the table shown in FIG. 9.
Figure 10:
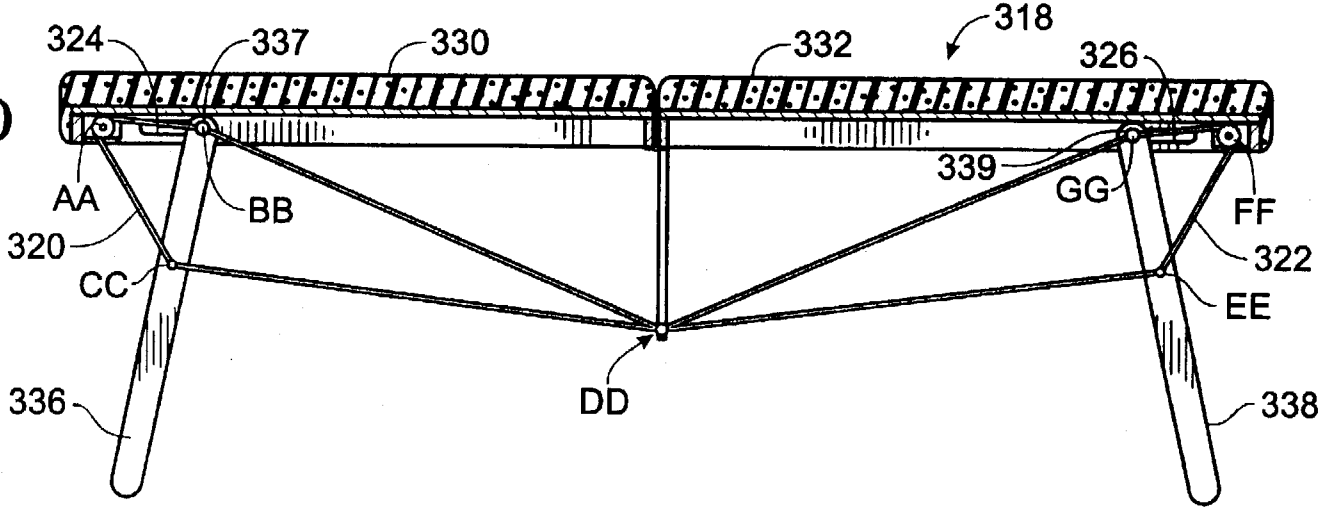
Figure 11:
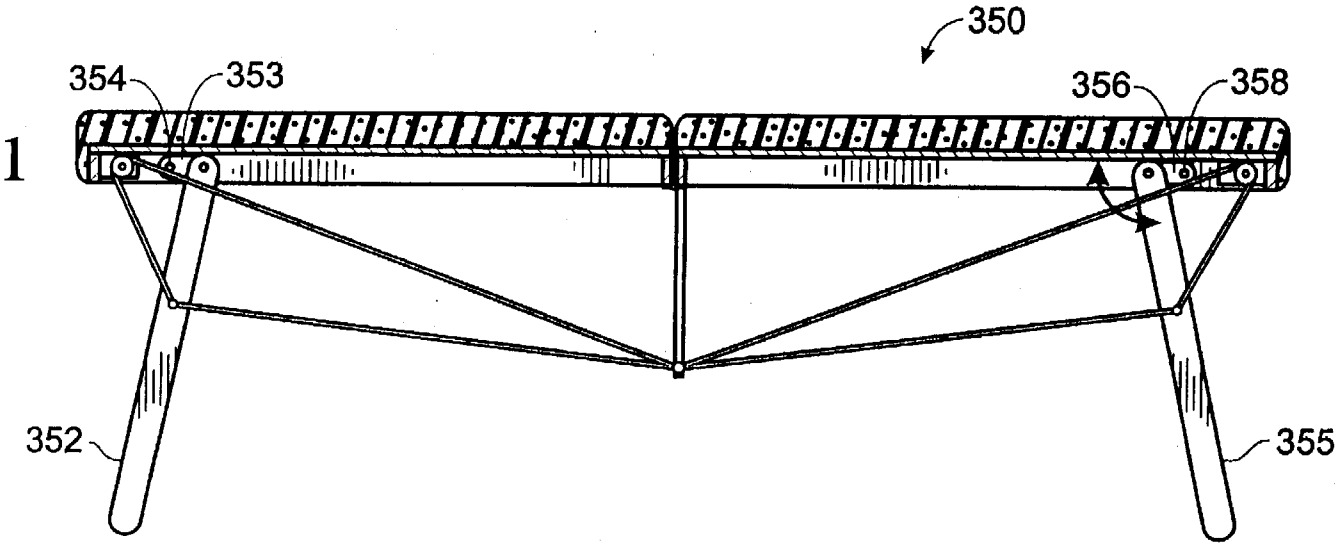

FIGS. 9–11 show related collapsible massage table designs which are simplified from prior designs because they eliminate the need for braces connecting the table legs to the center region of the table. In FIG. 9 table 300 includes two table pieces 302*a* and 302*b* hinged to each other in the center region of the table. Leg 304 is pivotally attached at point 306 to the underside of table piece 302*a*. Leg 308 is pivotally attached at point 309 to the underside of table piece 302*b*. Cable line 310 connects point CC on leg 304, to and around pulley AA, to point DD at the end of truss 311, and then to point EE on leg 308. Cable line 312 runs from point EE on leg 308, to and around pulley FF to point DD at the end of truss 311, and then to point CC on leg 304. The cable lines may consist of discreet cable pieces or may be one continuous piece. It is also possible for cable lines 310 and 312 to be made of one single cable.

Table 300 is different from the tables previously described in the sense that legs 304 and 308 rotate beyond a perpendicular position with respect to table top pieces 302*a* and 302*b*. This requires pivot points 306 and 309 to be set in from the respective ends of the table. The length of legs 304 and 308 are therefore limited by the requirement that each of the legs must be short enough to fold completely under its respective table top piece.

As shown in FIG. 10, table 318 is quite similar to table 300 of FIG. 9. Cable line 320 runs from point CC, to and around pulley AA, to point BB, to point DD, to point EE. Cable line 322 runs from point EE, to and around pulley FF, to point GG, to point DD, to point CC. Additionally, slots 324 and 326 are provided in the sides of table pieces 330 and 332 respectively. Leg 336 is connected to a support, for example, rod 337 which passes through slot 324 and connects in analogous fashion to a corresponding leg on the other side of the table. Leg 338 is connected to support rod 339 which passes through slot 326 and connects to the corresponding leg on the other side. By connecting cable line 320 to point BB, and cable line 322 to point GG, rods 337 and 339 automatically move to the proximal ends of slots 324 and 326 when the table is open. When table 318 is collapsed, each of rods 337 and 339 slide to the distal ends of respective slots 324 and 326. Thus, for a given table size, the design of FIG. 10 permits longer table legs 336 and 338 compared to legs 304 and 308 of table 300.

FIG. 11 shows table 350 which is similar to tables 300 and 318 of FIGS. 9 and 10. However, instead of employing a slot in the side of the table, leg 352 is pivotally attached to link 353 which is pivotally attached at point 354 to the side of the table. Leg 355 is pivotally attached to link 356 which is pivotally attached at point 358 to the side of the table. The cable line paths are the same as those used on table 300. When table 350 is collapsed, links 353 and 356 are rotated toward respective ends of the table so that longer legs may be accommodated within the table pieces when the table is collapsed.

Figure 12:
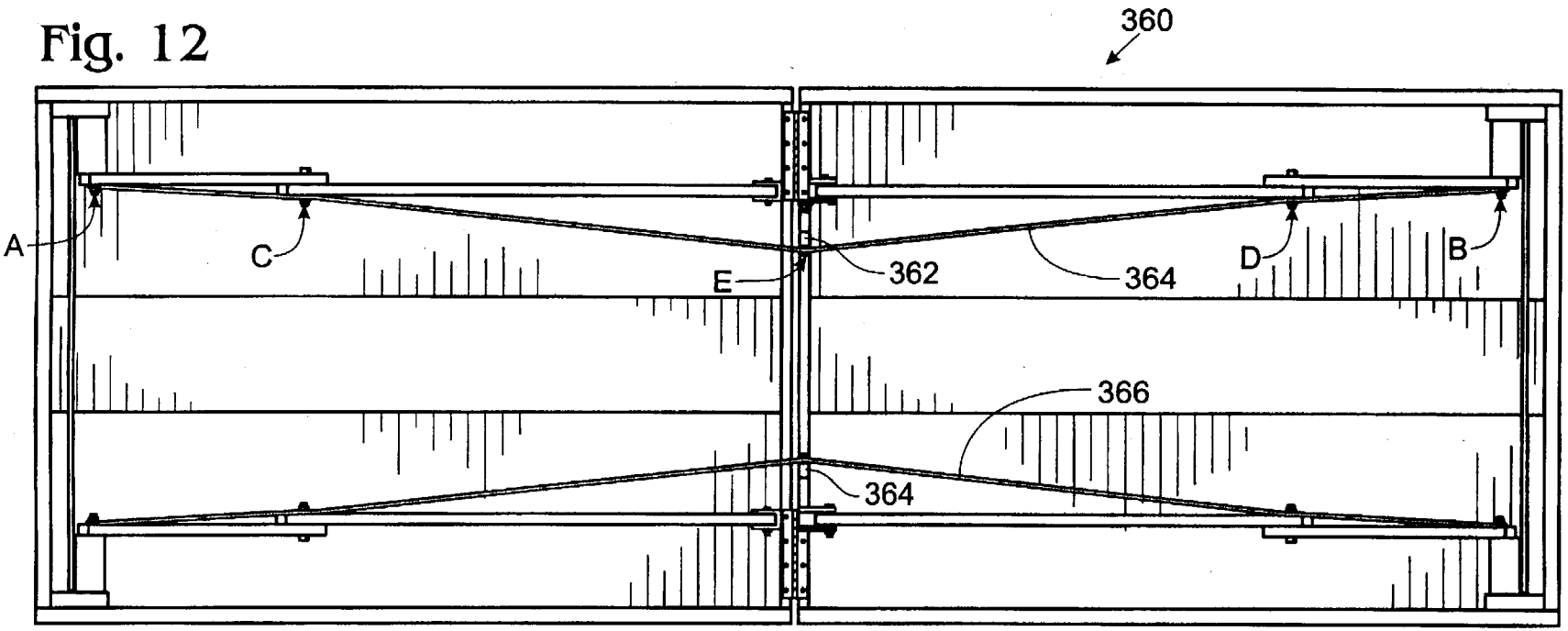
FIG. 12 shows a schematic bottom view of another embodiment of the present invention in which truss members are relocated toward the center of the table.

FIG. 12 shows a bottom view of a table support structure like the one illustrated in FIGS. 1 and 2 except truss members 362 and 364 have been relocated toward the center of the table. Cable lines 364 and 366 are attached to sides of respective truss member 362 and 364. Thus, cable lines 364 and 366 are moved from the outside edge of the table toward the center resulting in more leg room for the therapist. A number of other options are suggested by the design of FIG. 12. For example, truss members 362 and 364 could be replaced by a single truss member. Cable lines could also criss-cross in the center of the table suggesting a number of other possible cable support systems.

It is claimed and desired to secure by Letter Patent:

1. A collapsible table comprising a table top including two table pieces hingedly attached to each other so that when the table is erect the table pieces are substantially coplanar and when the table is collapsed the table pieces fold substantially together, wherein the table top has two sides, each side having a medial region located between first and second ends, each side of the table being supported by a support structure including: a first leg pivotally attached at point A below the first end of the side, a second leg pivotally attached at point B below the second end of the side, a first brace connecting the first leg to the medial region of the side, the first brace having an articulating joint at point C, a second brace connecting the second leg to the medial region of the side, the second brace having an articulating joint at point D, a first cable line running from point A to point D to point B, and a second cable line running from point A to point C to point B.

2. The table of claim 1 wherein each support structure further comprises a truss member extending down from the medial region of the side impinging on the first cable line between points A and D and on the second cable line between points C and B.

3. The table of claim 2 wherein each truss member is pivotally attached to one of the table pieces so that when the table is collapsed the truss member can be folded toward the table piece.

4. The table of claim 2 wherein the truss member impinges on cable lines the first and second at point E, the first cable line 1 making substantially straight line connections from points A to E, E to D and D to B, and the second cable line 2 making substantially straight line connections from points A to C, C to E and E to B.

5. The table of claim 1 wherein each cable line comprises plural discrete cable segments connected at common points along the cable line.

6. The table of claim 1 wherein each brace is connected to a corresponding brace on the other side of the table by a cross brace.

7. The table of claim 1 wherein each leg is connected to a corresponding leg on the other side of the table by a cross brace.

8. The table of claim 1 wherein each leg is extendible.

9. The table of claim 1 wherein the first cable line is attached to the first brace without significantly altering a substantially straight line path of the cable line between points A and D, and the second cable line is attached to the second brace without significantly altering a substantially straight line path of the cable line between points B and C.

10. The table of claim 1 wherein each cable line comprises a single piece of cable connecting all of the points along the cable line.

11. A collapsible table comprising a table top including two table pieces hingedly attached to each other so that when the table is erect the table portions are substantially coplanar and when the table is collapsed the table portions fold substantially together, wherein the table top has two sides, each side having a medial region located between first and second ends, each side of the table being supported by a support structure including: a first leg pivotally attached at point A below the first end of the side, a second leg pivotally attached at point B below the second end of the side, a first brace connecting the first leg to the medial region of the side, the first brace having an articulating joint at point C, a second brace connecting the second leg to the medial region of the side, the second brace having an articulating joint at point D, a first cable line running from point A to point D to point B, a second cable line running from point A to point C to point B, and a truss member extending down from the medial region of the side and impinging on the first cable line between points A and D and on the second cable line between points C and B.

12. The table of claim 11 wherein each cable line is made up of plural discreet cables connected at common points.

13. The table of claim 11 wherein each cable line is made of a single piece of cable.

14. The table of claim 11 wherein the cable lines are bolted to a side of the truss.

15. The table of claim 11 wherein each cable line has at least two discrete cable pieces which are connectable to the truss when the table is erect and detachable from the truss when the table is folded up.

16. The table of claim 11 wherein the truss is pivotally attached to one of the table pieces so that the truss can be positioned substantially perpendicular to the table top when the table is erect and the truss can be folded against said one of the table pieces when the table is folded up.

* * * * *

UNITED STATES PATENT AND TRADEMARK OFFICE

CERTIFICATE OF CORRECTION

PATENT NO. : 5,676,062

DATED : October 14, 1997

INVENTOR(S) : John T. Lloyd

It is certified that error appears in the above-indentified patent and that said Letters Patent is hereby corrected as shown below:

In column 2, line 10, delete "alteratively" and insert --alternatively-- therefor.

In column 2, line 33, delete "schematic" and the first instance of the word "side".

In column 2, line 35, delete "schematic" and insert --cross-sectional-- therefor.

In column 2, line 39, delete "schematic".

In column 3, line 61, delete "FIG. 1" and insert --FIG. 2-- therefor.

In column 4, line 62, delete "rims" and insert --runs-- therefor.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*